US005871110A

United States Patent [19]

Grimard et al.

[11] Patent Number: 5,871,110

[45] Date of Patent: Feb. 16, 1999

[54] TRANSFER ASSEMBLY FOR A MEDICAMENT CONTAINER HAVING A SPLASHLESS VALVE

[76] Inventors: Jean-Pierre Grimard, 14 Rue de Nord, Vif, France, 38450; Herbert Jansen, Le Domain de L'Enclose, Bat. E, Haute Jarrie, France, 38560

[21] Appl. No.: 713,581

[22] Filed: Sep. 12, 1996

[51] Int. Cl.[6] ..... B65D 47/00

[52] U.S. Cl. ..... 215/249; 215/301; 215/302; 215/307; 215/310; 215/274; 215/DIG. 3

[58] Field of Search ..... 604/246, 249, 604/30, 33; 215/DIG. 3, 247, 249, 301, 302, 299, 307, 310, 231, 270, 274, 275, 349, 350, 356

[56] References Cited

U.S. PATENT DOCUMENTS

| | | | |
|---|---|---|---|
| Re. 34,045 | 8/1992 | McFarland . | |
| 37,221 | 12/1862 | Dunton | 215/356 |
| 2,607,503 | 8/1952 | Sonnenberg . | |
| 2,667,986 | 2/1954 | Perelson | 215/247 X |
| 2,953,132 | 9/1960 | Richner et l. . | |
| 3,164,303 | 1/1965 | Trautmann . | |
| 3,206,080 | 9/1965 | Scislowicz . | |
| 3,356,093 | 12/1967 | Monahon | 141/349 |
| 3,357,427 | 12/1967 | Wittke et al. . | |
| 3,674,028 | 7/1972 | Ogle . | |
| 3,779,371 | 12/1973 | Rovinski . | |
| 3,838,689 | 10/1974 | Cohen . | |
| 4,020,839 | 5/1977 | Klapp . | |
| 4,187,893 | 2/1980 | Bujan | 215/247 X |
| 4,210,255 | 7/1980 | Pan . | |
| 4,336,891 | 6/1982 | Smith | 215/356 X |
| 4,387,879 | 6/1983 | Tauschinski | 604/249 X |
| 4,412,623 | 11/1983 | Schmidt . | |
| 4,418,827 | 12/1983 | Butterfield | 215/247 |
| 4,425,120 | 1/1984 | Sampson et al. . | |
| 4,573,976 | 3/1986 | Sampson et al. . | |
| 4,576,211 | 3/1986 | Valentini et al. . | |
| 4,672,996 | 6/1987 | Floyd et al. . | |
| 4,792,053 | 12/1988 | Towns et al. . | |
| 4,822,351 | 4/1989 | Purcell . | |
| 4,826,491 | 5/1989 | Schramm . | |
| 4,834,149 | 5/1989 | Fournier et al. . | |
| 4,834,152 | 5/1989 | Howson et al. . | |
| 4,850,994 | 7/1989 | Zerbst et al. . | |
| 4,884,703 | 12/1989 | O'Meara . | |
| 4,909,290 | 3/1990 | Coccia . | |
| 4,923,447 | 5/1990 | Morgan . | |
| 5,006,118 | 4/1991 | Yule . | |
| 5,088,996 | 2/1992 | Kopfer et al. . | |
| 5,116,326 | 5/1992 | Schmidt . | |
| 5,171,214 | 12/1992 | Kobler et al. . | |
| 5,215,538 | 6/1993 | Larkin | 604/249 |
| 5,217,433 | 6/1993 | Bunin . | |
| 5,232,109 | 8/1993 | Tirrell et al. . | |
| 5,291,991 | 3/1994 | Meyer . | |
| 5,348,548 | 9/1994 | Meyer et al. . | |
| 5,352,196 | 10/1994 | Haber et al. . | |
| 5,358,501 | 10/1994 | Meyer . | |
| 5,360,413 | 11/1994 | Leason et al. | 604/249 |
| 5,385,546 | 1/1995 | Kriesel et al. . | |
| 5,423,791 | 6/1995 | Bartlett . | |
| 5,425,465 | 6/1995 | Healy . | |
| 5,429,256 | 7/1995 | Kestenbaum . | |
| 5,487,737 | 1/1996 | Meyer . | |
| 5,494,170 | 2/1996 | Burns . | |
| 5,520,661 | 5/1996 | Lai et al. | 604/30 X |
| 5,533,983 | 7/1996 | Haining | 604/249 |
| 5,533,994 | 7/1996 | Meyer . | |
| 5,566,729 | 10/1996 | Grabenkort et al. . | |
| 5,598,939 | 2/1997 | Watson et al. . | |
| 5,613,291 | 3/1997 | Solomon et al. . | |
| 5,620,434 | 4/1997 | Brony | 604/249 X |
| 5,685,845 | 11/1997 | Grimard . | |
| 5,702,019 | 12/1997 | Grimard . | |

FOREIGN PATENT DOCUMENTS

| | | | |
|---|---|---|---|
| 65469 | 11/1982 | European Pat. Off. | 215/247 |
| 236127 | 9/1987 | European Pat. Off. | 215/247 |
| 0 406 374 B1 | 8/1993 | European Pat. Off. . | |
| 950625 | 10/1949 | France | 215/356 |
| 1 071 487 | 9/1954 | France . | |
| 1 487 413 | 7/1967 | France . | |
| 36 18 158 A1 | 12/1987 | Germany . | |
| 2 738 550 | 9/1997 | Germany . | |
| 501 172 | 2/1971 | Switzerland . | |
| 659519 | 10/1951 | United Kingdom | 215/356 |
| 2121016 | 12/1983 | United Kingdom | 215/247 |
| WO 95/03841 | 2/1995 | WIPO . | |

*Primary Examiner*—Stephen Cronin

*Assistant Examiner*—Robin A. Hyiton
*Attorney, Agent, or Firm*—Allen W. Wark

[57] ABSTRACT

A resealable transfer assembly for a container such as a bottle or vial featuring a membrane for selectively opening or sealing a fluid path between the bottle and a medical delivery device introduced into the assembly. The assembly includes a body disposed on the bottle, and a luer connector hub which may be separately provided with the body or formed integrally therewith. A free plug rests in a cavity defined within the luer connector hub. The free plug includes an orifice dimensioned to accept a luer tip associated with the medical delivery device. A membrane, preferably formed from an elastomeric material, is secured across both the opposed end of the luer connector hub and the open top of the bottle, and may be retained between the top surface of the bottle and the body. The membrane preferably includes a central area sealing the opposed end of the luer connector hub from the open top of the bottle, with one or more fluid openings defined on a portion of the membrane outside of the central area. When the luer tip is inserted into the orifice of the free plug, a force is exerted onto the central area to deflect the membrane towards the interior of the vial, urging the membrane from sealing contact with the body and, hence, opening the fluid path between the interior of the bottle and the medical delivery device. The membrane is resealed with the body prior to removal of the luer tip from the orifice to prevent fluid splashback from the container.

25 Claims, 9 Drawing Sheets

TRANSFER ASSEMBLY FOR A MEDICAMENT CONTAINER HAVING A SPLASHLESS VALVE

I. Field of the Invention

The invention relates to a transfer assembly for a medicament container, and more particularly, to a transfer assembly for a medicament container having a splashless valve.

II. BACKGROUND

Dry drugs such as powdered or lyophilized drugs are typically stored in sealed vials. In practice, the drug is accessed shortly prior to use by rupturing or piercing the seal. A solvent solution such as saline is then introduced into the vial to reconstitute the powdered or lyophilized drug. Once reconstituted, the drug solution is extracted from the vial for use.

Some prior art vials of powdered or lyophilized drugs include a pierceable membrane secured across the open top of the prior art vial. The membrane is normally pierced by a needle in communication with the solvent. However, care must be taken to avoid the separation of membrane fragments when the seal is pierced, as these may be accidentally delivered to the patient. Typically, these seals must be pierced each time access to the solvent is desired, heightening the problems associated therewith.

Other prior art vials include rubber stoppers that are either removed from or urged into the vial when delivering the solvent for reconstituting the drug. While in general these assemblies work well to safely store the drug prior to use, one drawback of these stoppers is that they cannot be accessed after they have fallen into the vial. Hence, the vial cannot be resealed employing the stopper originally provided. Accordingly, the structure of these prior art vials is not readily adapted to a vial capable of repeated opening or closing. Where a practitioner may not desire or need to administer the entire dose of reconstituted drug held in the vial, the vial would typically need to be resealed against the ambient environment to preserve the sterility of the drug remaining in the vial.

The stopper employed with a particular drug is typically formulated from a material compatible with the drug held in the vial. While the stopper normally poses no harm to the safety of the reconstituted drug, there may be a perception—however flawed—that the presence of the stopper in the interior of the vial somehow adversely affects the drug held therein. Also, there may be the perception that the presence of the stopper in the vial may interfere with the subsequent flow of the drug solution.

One way to address the foregoing concerns is to employ a membrane construction as part of the transfer assembly. The membrane may feature one or more fluid openings which are selectively operated by a practitioner by the attachment or removal of a medical delivery device to the transfer assembly. In such assemblies, the membrane is configured for self-sealing operation interim repeated uses of the vial. However, during use a slight over-pressure may build within the vial. The slight over-pressure may cause some splashing of medicament from the vial as the medical delivery device is removed from the transfer assembly.

III. SUMMARY OF THE INVENTION

A transfer assembly for a vial or bottle is provided for resealable fluid access to and from the interior of the vial or bottle. The assembly establishes a resealable fluid path between a medical delivery device for introducing into, or aspirating out of the bottle, fluids, and permits a practitioner repeated access to the drug held in the bottle while at the same time preserving its sterility. Moreover, the resealable transfer assembly is constructed to substantially prevent if not otherwise eliminate splashback from the vial when disengaging the medical delivery device from the transfer assembly.

The bottle includes an interior, an open top in fluid communication with the interior, and a top surface disposed around portions of the bottle surrounding the open top. The top surface may be formed, for instance, as an annular rim around the open top.

The transfer assembly features a body disposed on the top surface of the bottle. A fluid access device is disposed on the body to provide fluid access to and from the interior of the bottle. In one embodiment, the fluid access device may be configured as a luer connector hub. The luer connector hub defines a cavity for accepting a free plug. A connector end of the luer connector hub is configured for access by a component of a medical delivery device, while an opposed end is disposed for fluid communication with the open top of the bottle. Portions of the body surrounding the opposed end of the luer connector hub can be provided with a concave taper.

As noted hereinabove, a free plug is provided within the cavity defined by the luer connector hub. The free plug includes an open distal end, an open proximal end, and an outside wall defined between them for contact with the cavity of the luer connector hub. An orifice is also provided between the open distal end and the open proximal end, the orifice dimensioned to accept entry of a luer tip associated with a medical delivery device. The orifice can feature a taper conforming to the shape associated with conventional luer tips. The free plug is dimensioned for axial movement within the cavity between a sealed position, wherein fluid access to or from the open top of the vial is prohibited, and an activated position, wherein fluid access is opened to or from the open top of the vial. The outside wall of the free plug can be configured for slight frictional fit with the cavity of the luer connector hub; alternately, a threaded connection can be provided between them. Portions of the free plug adjacent the open proximal end can be configured to mate in fluid-tight relation with structure at the opposed end of the luer connector hub. Secondary sealing structure can be incorporated between the free plug and the opposed end of the luer connector hub.

If desired, the body and the luer connector hub may be provided as separate components, or they may be integrally formed as one component.

The connector assembly further includes a membrane disposed between the open top of the bottle and the opposed end of the luer connector hub. The membrane may be supported between the body and the top surface of the bottle. The membrane may be held in place, for instance, by an annular clip retaining the body to the top surface of the bottle. If desired, the body and the top surface of the bottle may be formed as an integral component, with the membrane secured in the integral component so as to be disposed between the opposed end of the luer connector hub and the open top of the bottle.

The membrane, which may be formed from an elastomeric material such as various thermoplastic elastomers, natural or synthetic rubbers, or the like, preferably includes a central area disposed for contact with the open proximal end of the free plug. The central area can be elevated from the surface of the adjoining membrane. The central area also features a width at least equal to the width defined by the open proximal end of the free plug. One or more fluid openings are preferably disposed on the membrane outside the central area. The openings form part of the resealable fluid path between the open top of the bottle and the medical delivery device.

One or more sealing ribs may be disposed on the body about the periphery of the open proximal end of the free plug. The sealing ribs are preferably disposed for sealing contact with the membrane in a location between the central area and the one or more openings. If desired, the sealing ribs may be provided on the membrane itself The membrane is displaceable between a sealing position, wherein the membrane is disposed for sealing contact with the body to close the fluid path, and an activated position, wherein the membrane is urged away from the body to open the fluid path. If desired, one or more fluid channels may be defined in the central area of the membrane to facilitate fluid flow between the medical delivery device and the membrane as the membrane is displaced by the free plug into its activated position.

If desired, a luer lock seal may be provided to seal the connector end of the luer connector hub. In one configuration, the luer lock seal may be provided as a detachable membrane. In another configuration, the luer lock seal can be provided as a cap which is threadably engageable with the connector end of the luer connector hub. The luer lock seal prevents inadvertent access to the interior of the bottle until use is ultimately desired. Also, if desired, a protective cap may be fitted about the exterior of the bottle to protect the luer connector hub. The cap may be affixed with a tamper-evident seal, as is conventional.

In use, the luer lock seal (if provided) is removed by the practitioner, so that the connector end of the luer connector hub is disposed for access by the medical delivery device. The medical delivery device may feature a male luer tip which is insertable into the orifice of the free plug through the connector end of the luer connector hub, such that the male luer tip and the orifice are disposed in fluid-tight relation to one another. Continued downward motion of the male luer tip will exert a proximally-directed force against the central area of the membrane, such that the membrane will be displaced into its activated position. The membrane will be displaced from its sealing contact with the sealing ribs, thereby creating a gap between the membrane and the sealing ribs. Fluid flow is thereby permitted between the medical delivery device and the interior of the bottle via the one or more channels formed in the central area of the membrane and, via the one or more openings in the membrane, the fluid path between the open top of the bottle and the medical delivery device. The concave taper of the body surrounding the opposed end of the luer connector hub contributes to full aspiration of fluid from the vial into the medical delivery device. Upon removing the medical delivery device from contact with the central area, the membrane will re-deflect towards its sealed position prior to disconnection of the luer tip from the orifice of the free plug. The membrane will thus be redisposed for sealing contact with the ribs, closing the fluid path. At the same time, splashback is prevented which might occur if the luer tip were disconnected from the orifice before the membrane had resealed.

IV. BRIEF DESCRIPTION OF THE DRAWINGS

The invention will now be described in greater detail by way of reference to the appended drawings, wherein.

Figure 4:
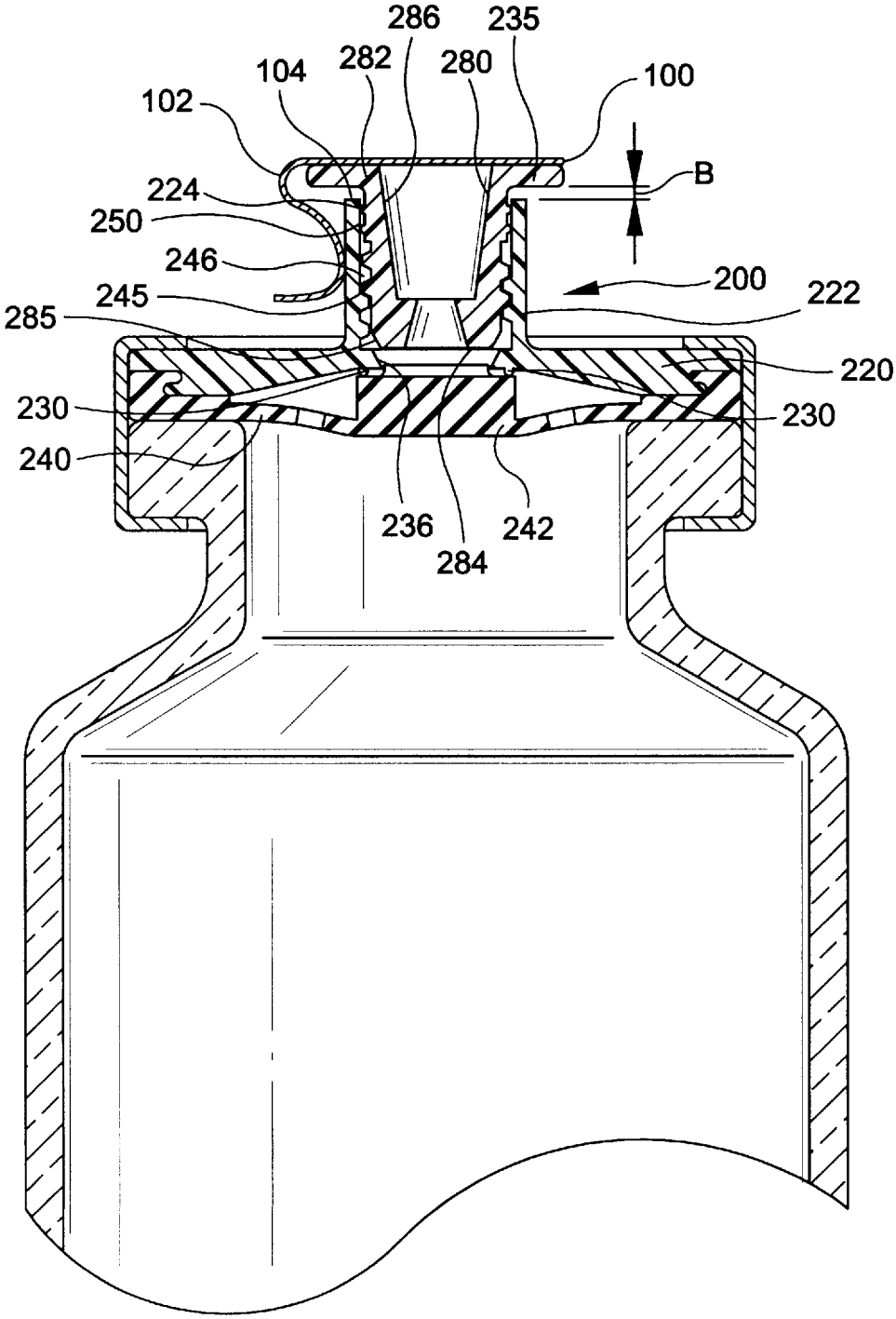
FIG. 4 is a cross-sectional view of another embodiment of a resealable transfer assembly in accordance with the present invention.
Figure 5:
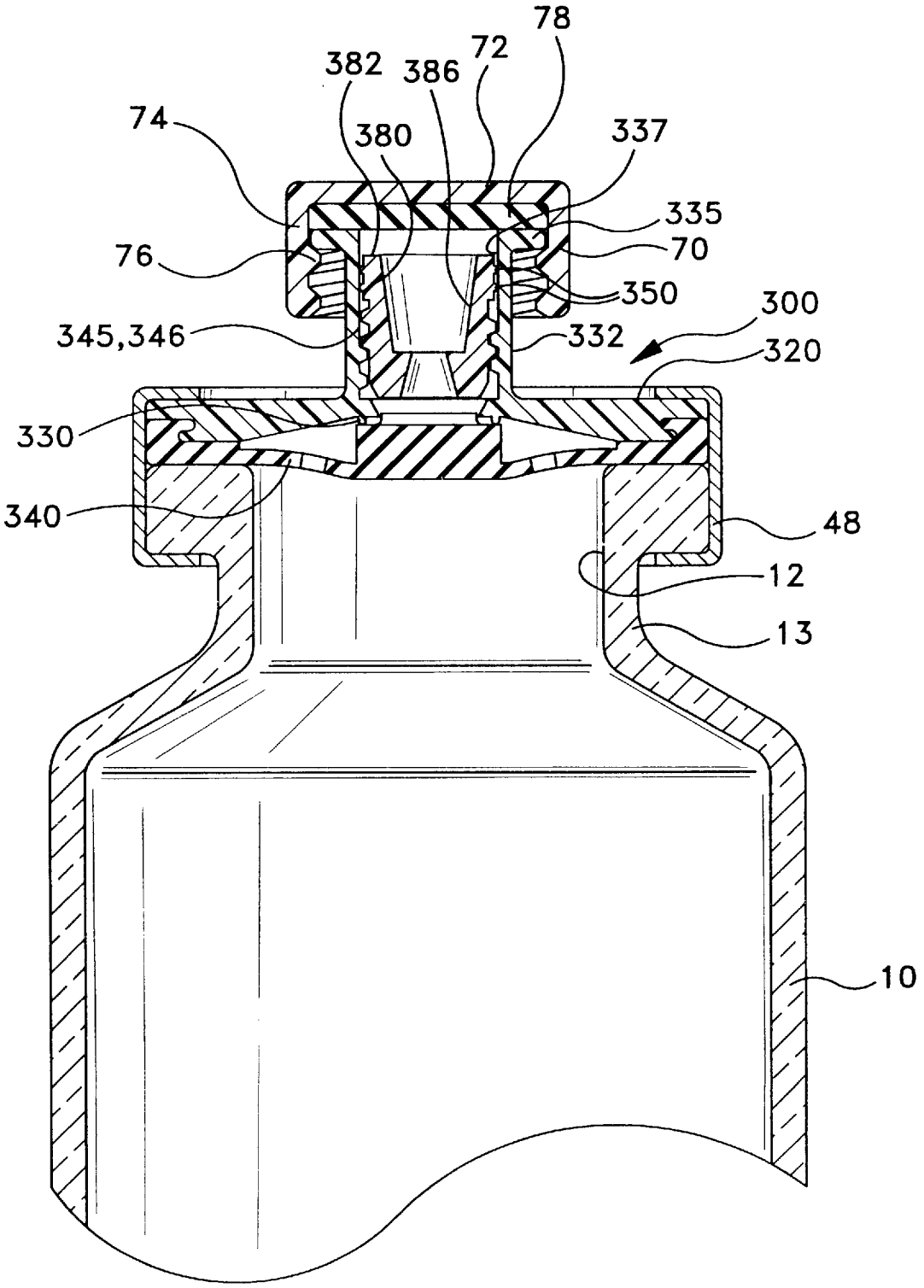
FIG. 5 is a cross-sectional view depicting another embodiment of a resealable transfer assembly in accordance with the present invention.
Figure 6:
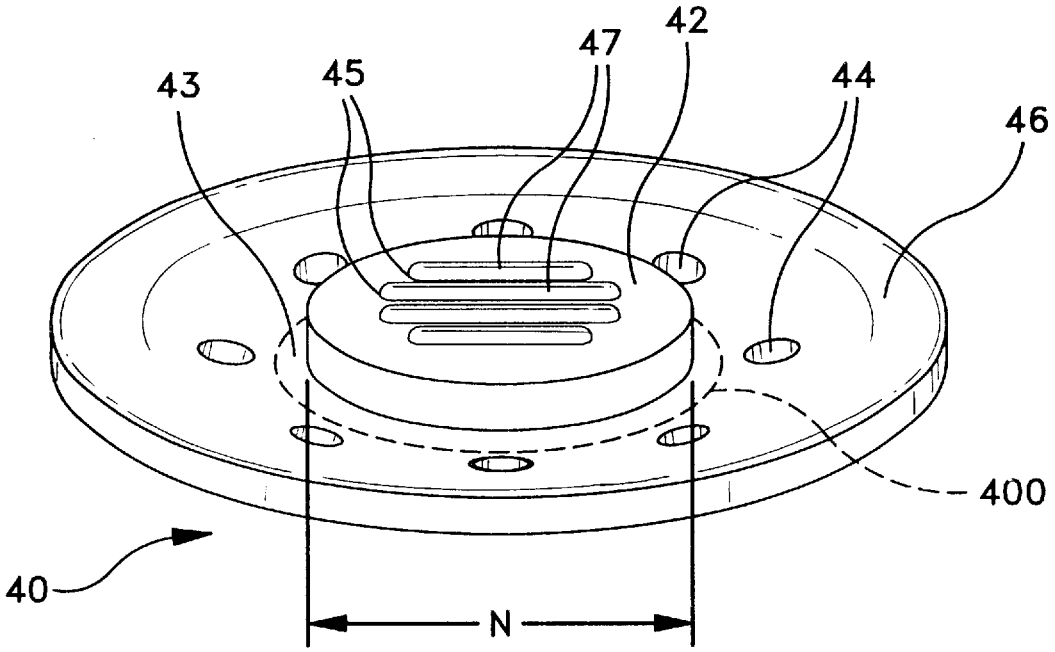
FIG. 6 depicts one embodiment of the membrane illustrated in FIGS. 2–5.
Figure 6A:
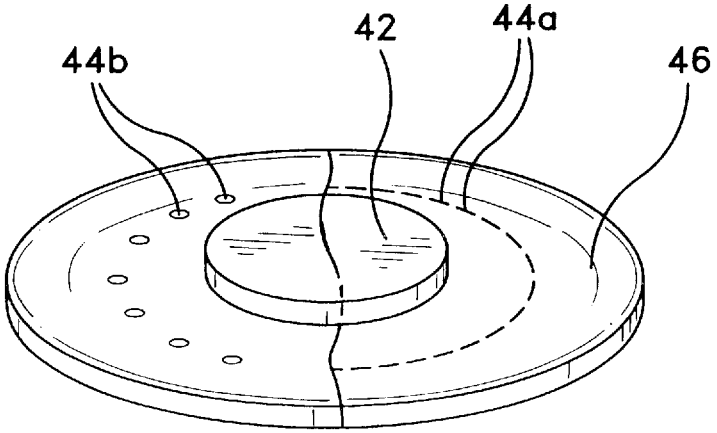
Figure 6B:
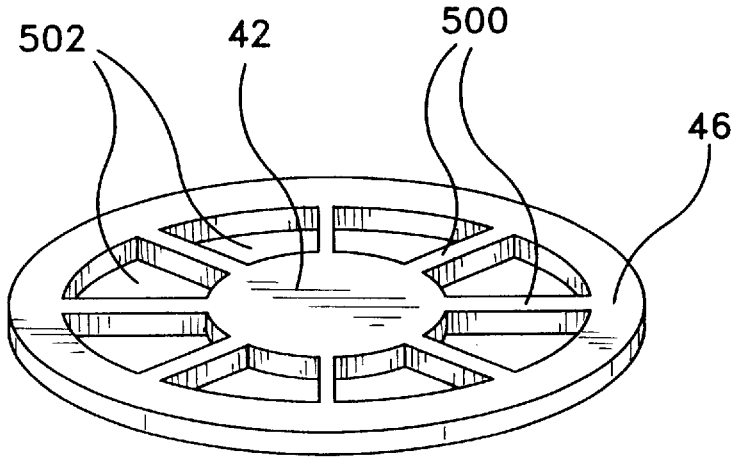
Figure 8:
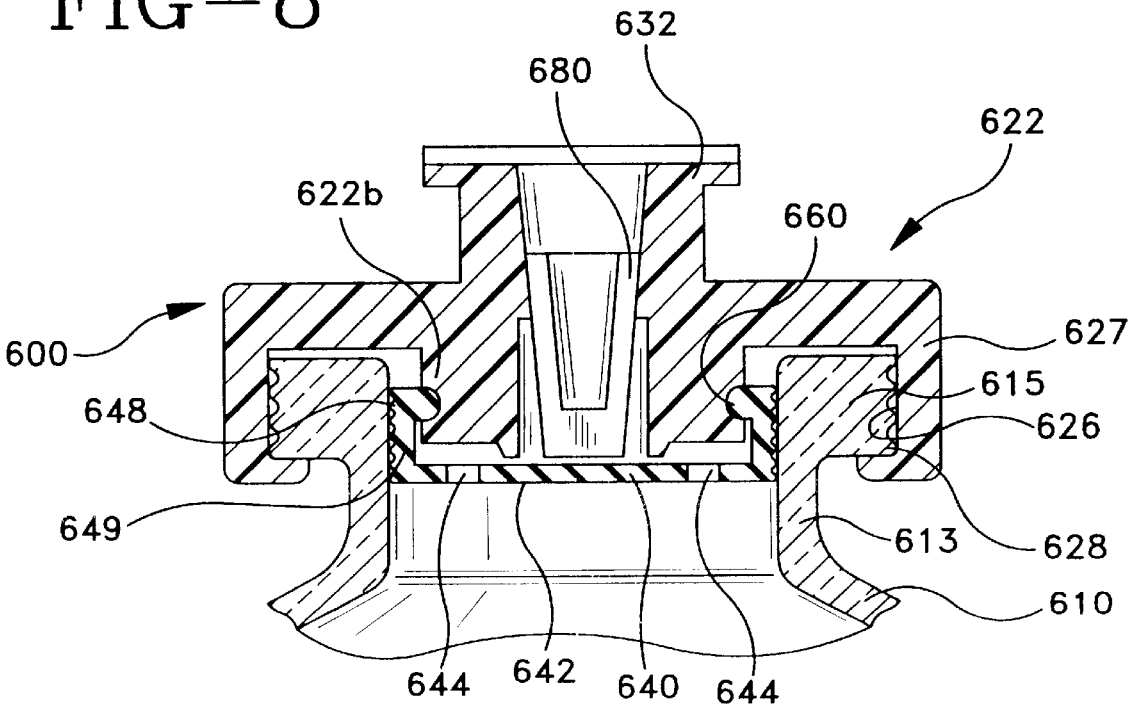

FIG. 6*a* illustrates a variant of the membrane shown in FIG. 6;

FIG. 6*b* illustrates another variant of the membrane illustrated in FIGS. 2–5;

FIGS. 7*a*–7*d* depict various structures for enhancing retention of the membrane between the body and the top surface of the bottle;

FIG. 8 depicts another embodiment of a resealable transfer assembly.

DETAILED DESCRIPTION OF THE PREFERRED EMBODIMENTS

While the description and figures herein makes reference to a vial or bottle, it will be understood and appreciated by the skilled artisan that any type of container normally employed in the field of endeavor, such as capsules, jars or like vessels are readily amenable to the advantages described herein. In addition, while herein described with regard to containers having a quantity of dry drug or medicament for reconstitution by liquid obtained from an external source, it will be appreciated by the skilled artisan that the invention is not so limited. For instance, the invention may be applied to containers holding therein a quantity of liquid medication, wherein repeated access is desired. Additionally, while the invention described herein is explained principally with reference to fluid communication means illustrated as a luer connector hub, it will be evident to the skilled artisan that the principles are equally applicable to other fluid communication means such as a needle or spike.

Figure 1:
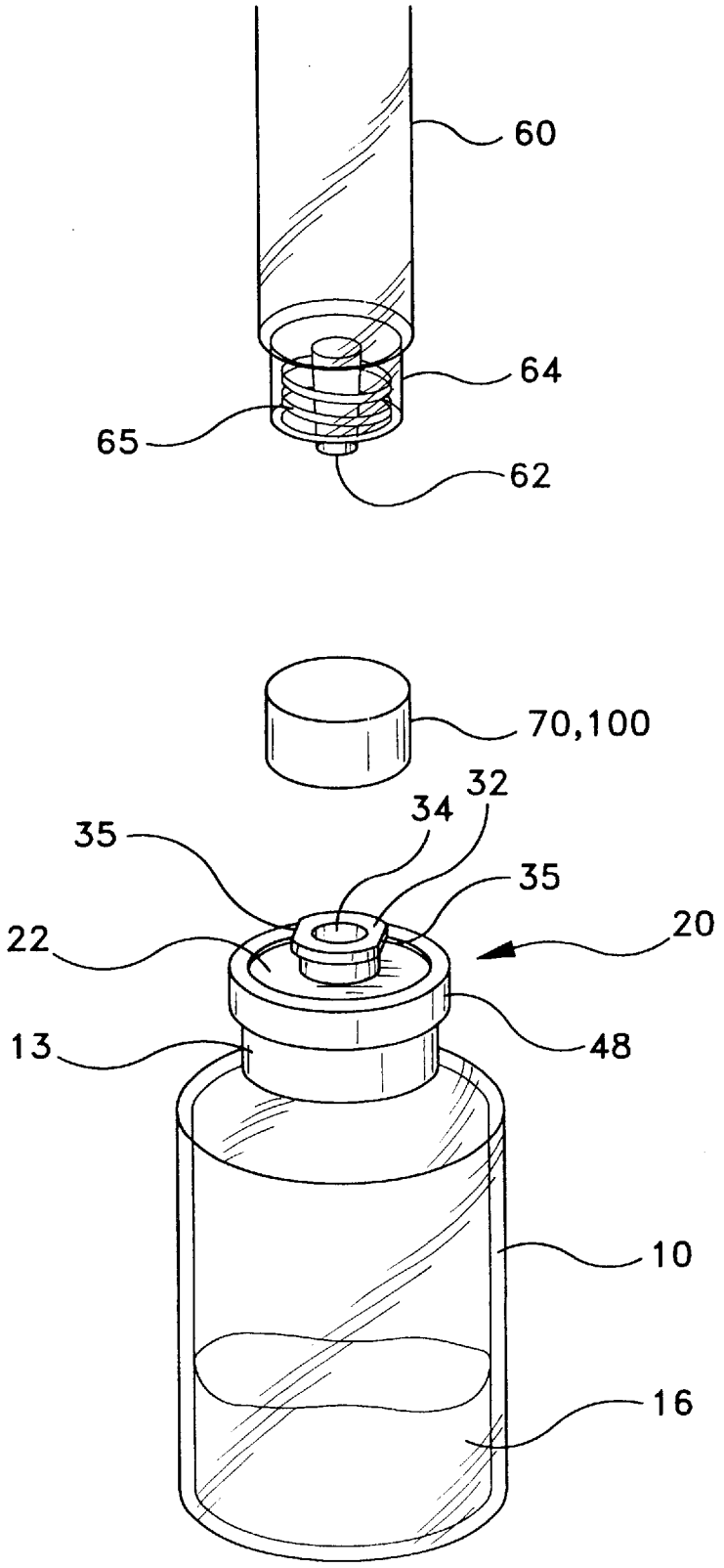
FIG. 1 is a blow-up view in perspective of a resealable transfer assembly affixed to a bottle containing therein a drug, with a medical delivery device such as a syringe employed to deliver to the drug.
Figure 2:
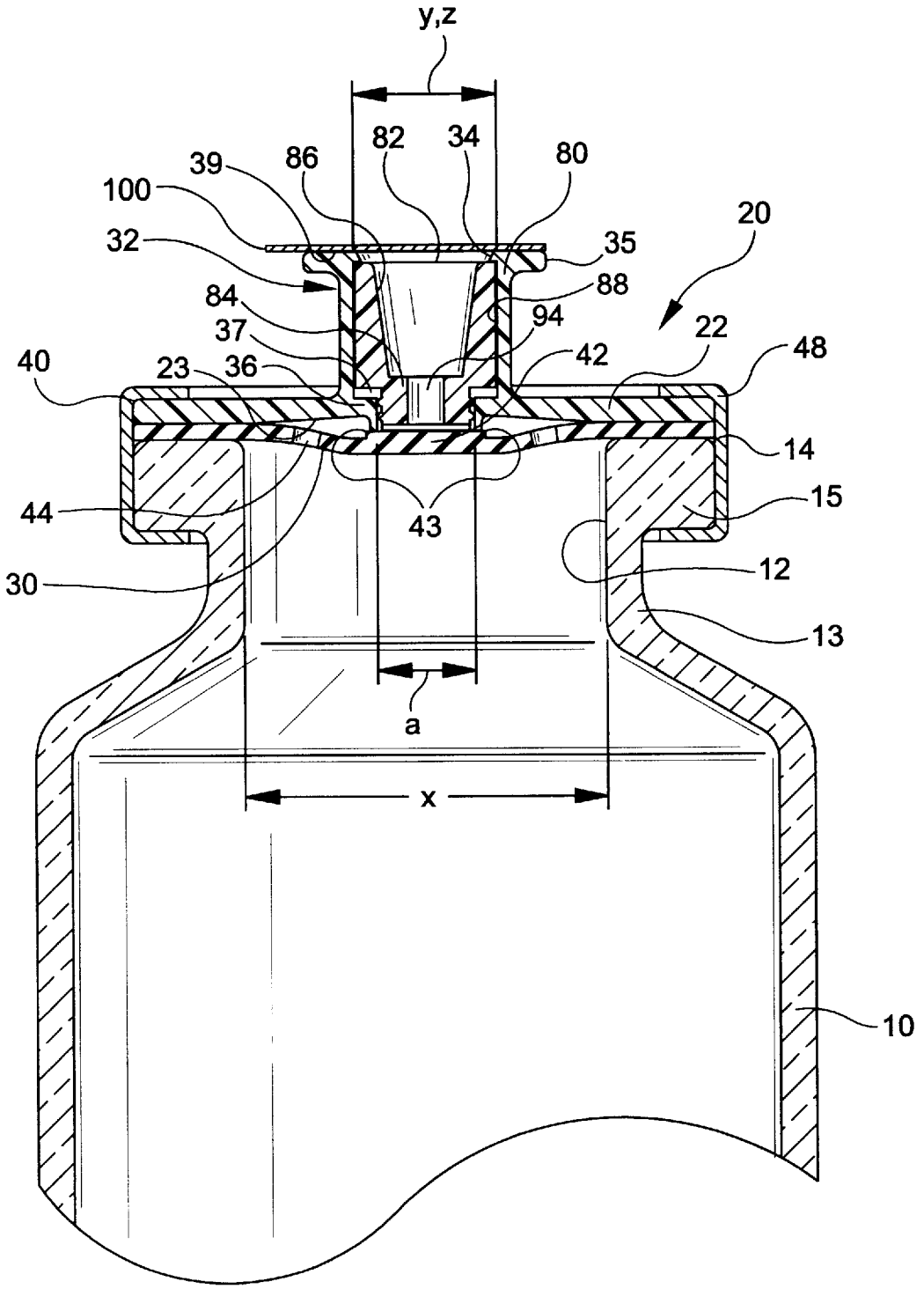
FIG. 2 is a cross-sectional view depicting one embodiment of a resealable transfer assembly in accordance with the present invention in its storage position.
Figure 3:
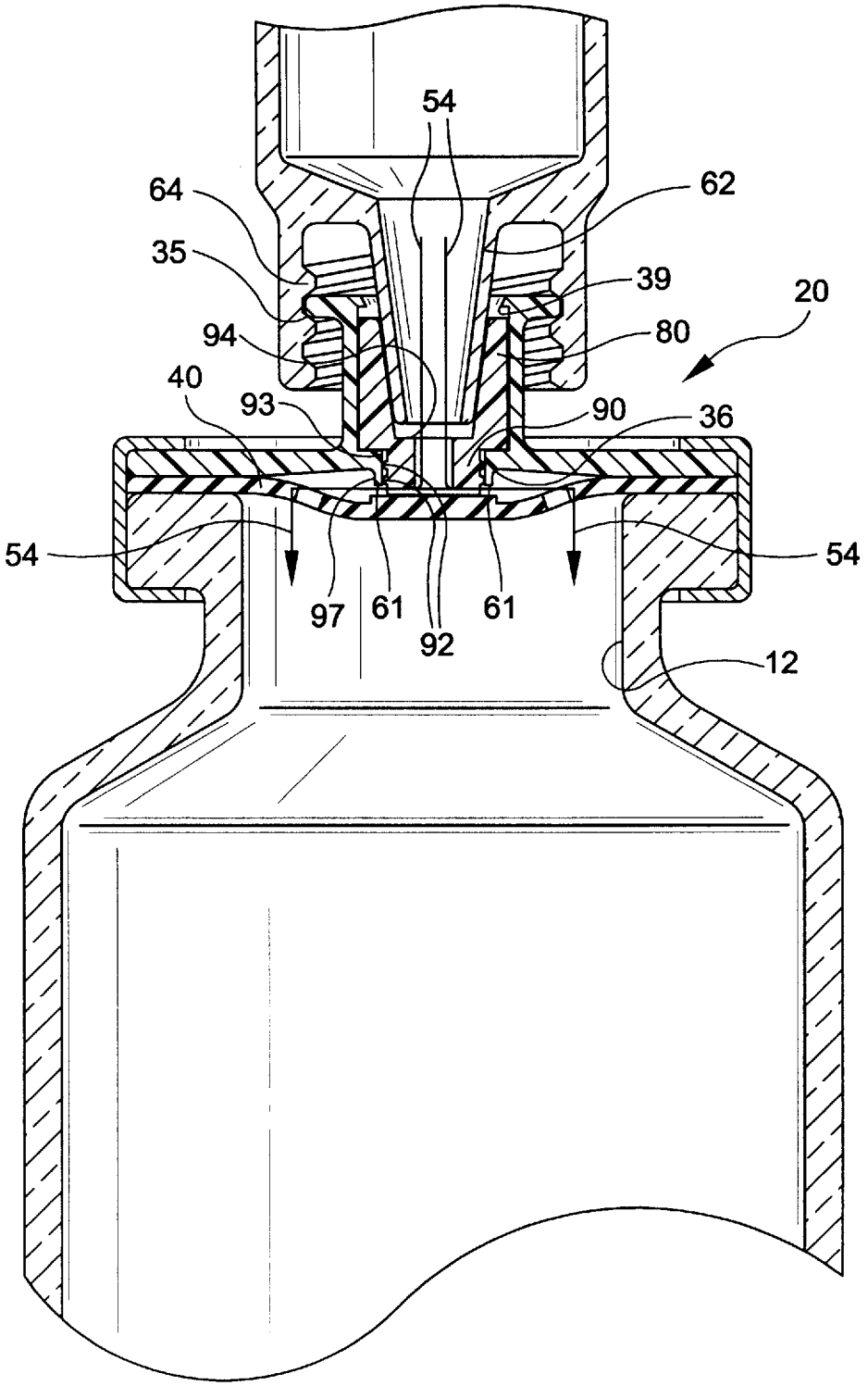
FIG. 3 is a cross-sectional view of the resealable transfer assembly of FIG. 2, illustrating displacement of the free plug and membrane to the open position by action of the medical delivery device, thereby opening the fluid path between the medical delivery device and the open top of the bottle.

Turning now to the drawings, wherein like numerals depict like components, FIGS. 2 and 3 depict an embodiment 20 of a resealable transfer assembly in accordance with the present invention, and FIG. 1 is an exploded perspective view of resealable transfer assembly 20 mounted to a bottle or vial 10 containing therein a drug 16. Drug 16 may entail, for instance, a medicament in powdered or granular form, such as a lyophilized medicament, intended to be reconstituted by a fluid introduced into vial 10 by a medical delivery device such as syringe 60. Alternately, it will be appreciated by the skilled artisan that drug 16 may entail a fully liquid medicament to which repeated access by the practitioner is desired.

Syringe 60 may feature, for instance, a male luer tip 62 for introducing fluid into the interior of bottle 10 via a luer connector hub 32 associated with the resealable bottle assembly 20, as will be more fully described herein. Syringe 60 may also display a luer lock collar 64 surrounding luer tip 62. Internal portions of luer lock collar 64 may include a thread 65. Thread 65 is engageable with an edge 35 such as a luer wing associated with luer connector hub 32. Alternately, thread 65 is engageable with an edge 235 provided around a free plug 280 (see FIG. 4) as will be described herein. While syringe 60 as herein depicted is preferably configured as a luer lock syringe, it will be evident to the skilled artisan that the invention is equally amenable to luer slip syringes. It will also be evident to the skilled artisan that syringe 60 may serve to aspirate reconstituted drug 16 from bottle 10.

As will be evident from the various drawings, bottle 10 may include a neck portion 13 defining an open top 12 with a width "X". Bottle 10 further preferably includes a top surface 14 disposed around open top 12. In the configuration depicted herein, top surface 14 is defined by an uppermost portion of an annular rim 15 formed around open top 12 of the bottle. It will be realized by the skilled artisan that the top surface of the bottle may also be established by rings or other means attached about open top 12 of the bottle.

Turning now to FIGS. 2 and 3, resealable transfer assembly 20 features a relatively disc-like body 22 provided on top surface 14 of the bottle. Body 22 is characterized by an inwardly-directed face 23. As illustrated, face 23 tapers concavely away from open top 12 of the bottle. Body 22 may be formed separate from bottle 10, and attached to top surface 14 of the bottle by securing the body to annular rim 15 with a crimp cap 48. It will also be evident to the skilled artisan that in lieu of a body separately supplied, body 22 may be unitarily formed with bottle 10. For instance, body 22 may define a contiguous extension of annular rim 15.

Resealable transfer assembly 20 includes means for communicating with bottle 10, fluids either supplied by a medical delivery device such as syringe 60 or which will be aspirated out of bottle 10. Such means for communicating may take many forms, and need not be restricted to any one type of structure. For example, the means for communicating fluids can be formed as a needle transfer assembly as taught, for instance, in U.S. Pat. No. 5,487,737. They can also entail structure such as spikes as taught, for instance, in U.S. Pat. No. 5,358,501. As here depicted, the means for communicating fluids is provided as a luer connector hub 32. Other means will be envisioned by the skilled artisan.

The luer connector hub 32 features a connector end 34 configured for access by luer tip 62 of the syringe, and an opposed end 36 adjacent open top 12 of the bottle. Here, opposed end 36 is illustrated as part of the structure of body 22. A cavity 37 is provided between the connector and opposed ends of the luer connector hub. A locking abutment 39 may also be provided in the cavity adjacent connector end 34, for purposes to be hereinafter described. As illustrated in FIG. 2, opposed end 36 of the luer connector hub may define a width "A" less than the width "X" of open top 12 of the bottle. For purposes which will be hereinafter more fully described, a sealing rib 30 is preferably provided about the periphery of opposed end 36 of the luer connector hub. Sealing rib 30 may be formed as part of body 22, or it can form an extension of opposed end 36 of luer connector hub 32.

It will be apparent to the skilled artisan that luer connector hub 32 may be supplied separately from body 22 and affixed thereto, for instance, by adhesives, welding, or like affixation methods. Likewise, it will be realized by the skilled artisan that, if desired, luer connector hub 32 may be unitarily formed with body 22.

Resealable bottle assembly 20 preferably features a membrane 40 which is displaceable between an open position (FIGS. 3) and a closed position (FIGS. 2, 4, 5) relative to body 22. As will be herein described, when the membrane is disposed in its open position, a fluid path 54 is established between luer tip 62 and open top 12 of the bottle, permitting free fluid flow between syringe 60 and the interior of bottle 10. Likewise, fluid path 54 is closed when membrane 40 is returned to its closed position, preventing fluid flow through luer connector hub 32, and isolating the interior of bottle 10 from the ambient environment.

As depicted in FIGS. 2–6, membrane 40, which may be formed from an elastomeric material such as various thermoplastic elastomers, natural or synthetic rubbers, or the like, can be configured in a roughly cylindrical, planar manner. Membrane 40 includes an edge 46 securable between body 22 and top surface 14 of the bottle, for instance, by the force exerted by crimp cap 48. Membrane 40 preferably includes a central area 42 having a width "N" at least equal to width "A" of opposed end 36 of the luer connector hub. As here illustrated, central area 42 is configured in a platform-like manner raised from the surrounding portions of membrane 40. Membrane 40 is actuated into its activated position (FIGS. 3) when luer tip 62 is inserted through open end 34 of the luer connector hub into an orifice 86 of free plug 80, as hereinafter described. Thus, when the membrane is secured to bottle 10, central area 42 is disposed fully across the opposed end of luer connector hub 32.

Figure 7A:
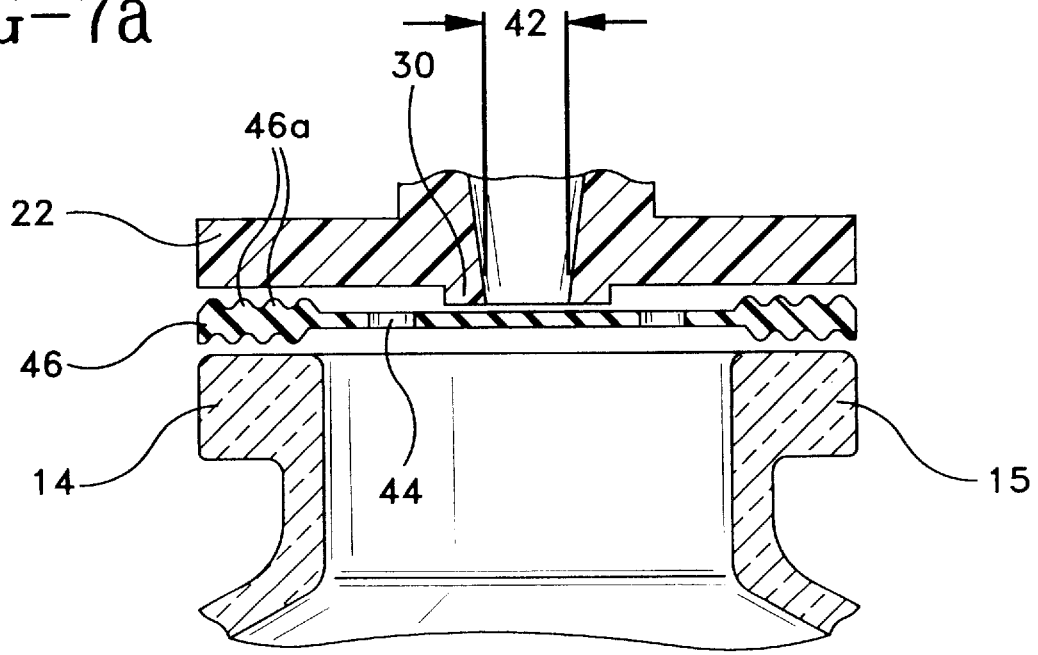
Figure 7B:
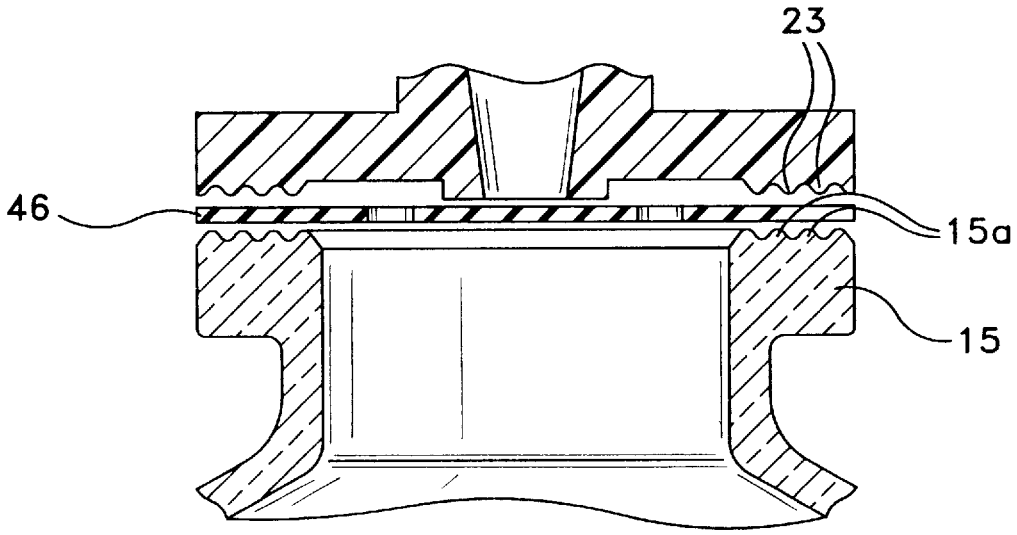
Figure 7C:
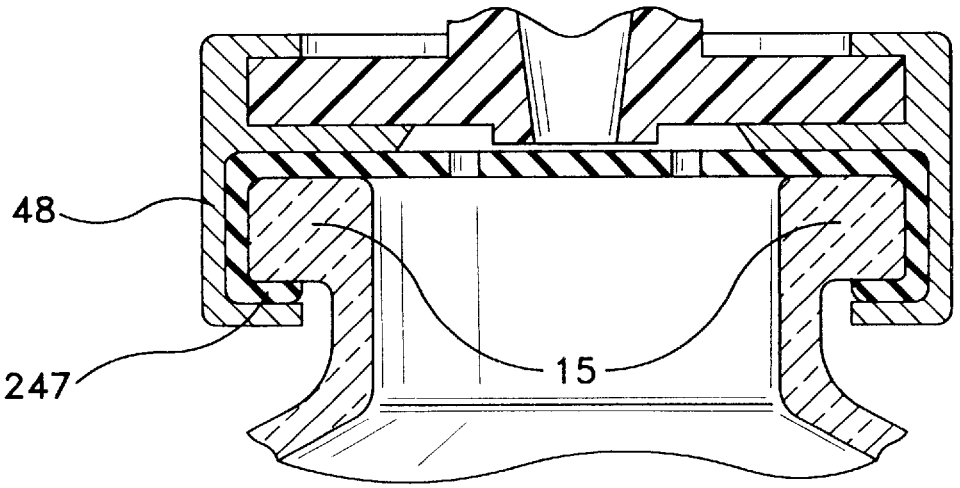
Figure 7D:
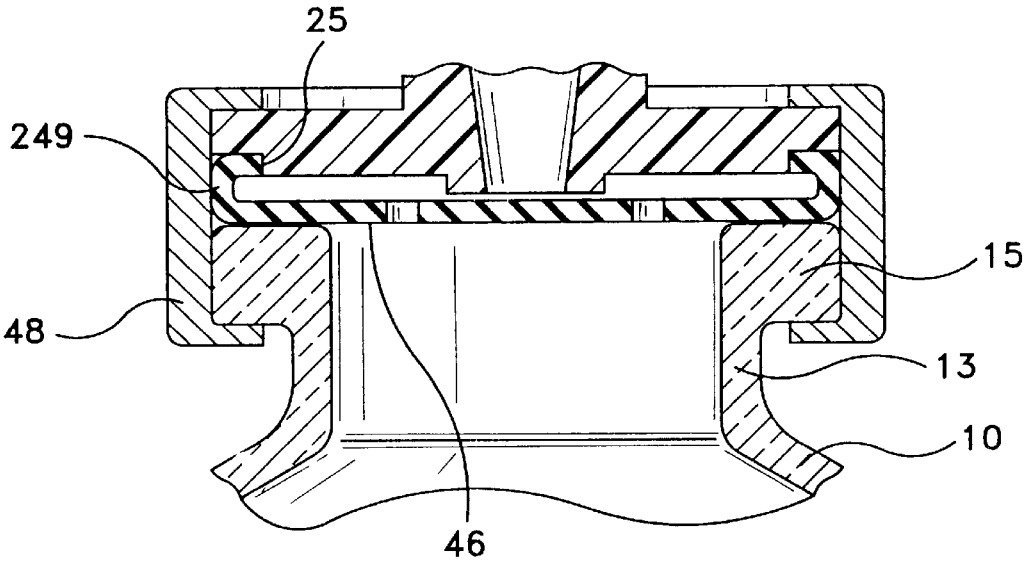

Various structures may be incorporated to assist in the retention of membrane 40 between body 22 and the top surface of the bottle and to increase the sealing action between the body and the top surface of the bottle. For instance, ribs 46*a* (FIG. 7*a*) may be incorporated onto edge 46 to provide extra grip between body 22 and annular rim 15. Likewise, ribs 23 and/or ribs 15*a* (FIG. 7*b*) may be incorporated on the body and/or the annular rim, respectively, for the same purpose. Alternately, as seen in FIG. 7*c*, membrane 40 may include a flap 247 which is locked beneath annular rim 15 by the action of crimp cap 48. Likewise, the membrane might include a portion 249 wedged into a slot 25 defined in body 22 (FIG. 7*d*), enhancing the gripping action of the crimp cap. Other variations will be envisioned by the skilled artisan.

Fluid passages are provided on membrane 40 to enable fluid communication between the open top of the bottle and the opposed end of the luer connector hub. In one configuration, the fluid passages are configured as one or more openings 44 preferably defined on membrane 40 outside of central area 42. Openings 44 form part of fluid path 54 when membrane 40 is disposed in its open position. The one or more openings 44 are located on membrane 40 such that when the membrane is disposed in its closed position (FIGS. 2, 4, 5), sealing rib 30 will contact the membrane in a sealing area 43 located around the membrane between central area 42 and the one or more openings, sealing luer connector hub 32 from fluid communication with open top 12 of the bottle, hence closing fluid path 54. It will also be realized that membrane 40 may be designed or otherwise formed from an appropriate material such that when the membrane is in its closed position, the one or more openings 44 will rest flush against body 22 (not shown), further sealing the luer connector hub from fluid communication with the open top of the bottle.

It will be realized by the skilled artisan that in lieu of openings 44, the fluid passages may be realized as prepierced slits 44*a* or pinpoint type punctures 44*b* (See FIG. 6*a*) formed or otherwise provided through membrane 40. Slits 44*a* or punctures 44*b* are configured such that when membrane 40 is disposed in its open position, the slits/punctures will be stretched open to provide fluid access between the open top of the bottle and the luer connector hub. Likewise, when the membrane is disposed in its closed position, slits 44*a* or punctures 44*b* will close, thereby providing a self-sealing ability to enhance the sealing provided by rib 30.

To facilitate fluid flow between luer tip 62 and open top 12 of the bottle, one or more fluid channels 45 may be provided on central area 42 (FIG. 6). Fluid channels 45, if provided, form part of fluid path 54 openable between luer tip 62 and open top 12 of the bottle. As herein depicted, fluid channels 45 may entail spaces that are defined between ribs 47 formed on the central area. Fluid channels 45 effectively communicate fluid supplied or aspirated via luer tip 62 with portions of membrane 40 outside of central area 42.

Resealable transfer assembly 20 features a free plug 80 located within cavity 37 of the luer connector hub. Free plug 80, is preferably formed from an appropriate plastic material and includes an open distal end 82, an open proximal end 84, and an orifice 86 formed therebetween. The orifice 86 is designed to accept male luer tip 62 of a medical delivery device such as syringe 60. In this vein, orifice 86 can be tapered between distal end 82 and proximal end 84 so that male luer tip 62 and orifice 86 engage in fluid-tight contact when the male luer tip is inserted into the orifice. Free plug 80 is disposed for axial movement within cavity 37 between a storage position, where membrane 40 is disposed in sealing contact with body 22 (FIG. 2), and an activated position, wherein membrane 40 is disposed in an activated position, opening fluid path 54 (FIG. 3). Free plug 80 is securely retained within luer hub 32 via locking abutment 39.

Free plug 80 can be configured with an outside wall 88 frictionally retained against cavity 37. One or more sealing ribs (not shown) can be disposed on the outside wall for sealing contact with cavity 37. Preferably, outside wall 88 (or, if provided, the sealing ribs) defines a diameter slightly greater than internal diameter "Z" of cavity 37 such that a substantially fluid-tight contact is established between cavity 37 and outside wall 88 of the free plug.

Free plug 80 can be structured for sealing action with the open, opposed end 36 of the luer connector hub. To this end, proximal end 84 of the free plug may be configured to sealingly mate with complimentary structure on body 22 and/or luer hub 32. In one configuration, free plug 80 can include a proximally directed neck 90 configured to extend through a cylindrical section 93 provided at the open opposed end 36 of the luer connector hub. One or more secondary sealing rings 92 can be provided about the periphery of neck 90 so that neck 90 is retained in fluid-tight relation with cylindrical section 93 of the opposed end of the luer connector hub in either the storage (FIG. 2) or activated (FIG. 3) positions. Note that a nozzle 94 communicating with orifice 86 is provided through neck 90. Nozzle 94 is disposed for fluid communication with fluid channels 45 provided on central area 42 of the membrane.

Resealable transfer assembly 20 may further include an external seal for preserving the sterility of the various components, inclusive of drug 16, pending use. In one configuration, the seal can entail a membrane 100 of suitable material affixed over connector end 34 of the luer connector hub. To prevent inadvertent detachment and to provide visual indication of tamper evidence, free end 102 of the membrane can be welded to the luer connector hub at a location 104 (see FIG. 4). Alternately, the external seal can be configured as a cap 70 disposed over connector end 34 of the luer connector hub (see FIG. 5). Cap 70 features a circular end wall 72, and a cylindrical side wall 74 with an internal thread 76 configured for threadably engaging edge 35 provided with connector end 34 of the luer connector hub. A suitable sealing material 78, such as a rubber seal, may be secured to the interior face of circular end wall 72. Accordingly, cap 70 can be threadedly engaged onto luer connector hub 32 and tightened such that sealing material 78 sealingly engages open connector end 34 of the luer connector hub. Thus, a barrier is established against the passage of contaminants or other unwanted material through connector end 34 of the luer hub which (if otherwise uncovered), would provide communication through the luer connector hub and, potentially, through open top 12 of bottle 10.

When a practitioner desires to introduce fluid to drug 16 held within bottle 10, luer lock seal 70 (or 100) is removed from connector end 34 of the luer connector hub. Connector end 34 is thus exposed for insertion of luer tip 62 of syringe 60 into orifice 86 of the free plug. By manual force exerted by a user upon syringe 60 or, when the structure is provided, by threadedly engaging luer lock collar 64 with edge 35 of the luer connector hub, luer tip 62 is urged into fluid-tight contact with orifice 86. Luer tip 62 urges free plug 80 proximally in cavity 37, such that neck 90 will exert a proximally directed force against central area 42 of the membrane. It will be seen that neck 90 urges membrane 40 towards the interior of bottle 10, displacing the membrane to its open position. A gap 61 is created between sealing rib 30 and central area 42. With the opening of gap 61, fluid path 54 is completed between the luer tip and the interior of the bottle 10. Via fluid path 54, fluid flow is fully enabled between syringe 60 and the interior of the bottle via: luer tip 62; fluid channels 45; gap 61; and the one or more openings 44 provided in membrane 40.

A practitioner may now advance a plunger (not shown) associated with syringe 60, thereby supplying fluid to the interior of bottle 10. Thereafter, keeping fluid path 54 open by maintaining the connection between syringe 60 and luer connector hub 32, the practitioner may re-aspirate the now reconstituted drug 16 into syringe 60, causing the reverse fluid flow—i.e., drug 16 may flow into syringe 60 via: the one or openings 44; gap 61; fluid channels 45; and luer tip 62. The drug 16 is thus ready for administration by the practitioner, as desired.

Where it is not desired or necessary to utilize all of drug 16 held within bottle 10, the practitioner may simply reseal bottle 10 by disengaging syringe 60 from luer connector hub 32. Advantageously, resealable transfer assembly 20 in accordance with the present invention substantially prevents if not otherwise eliminates splashback of fluid from the vial that may occur, for instance, if the interior of the vial becomes slightly-pressurized during the reconstitution process. It will be appreciated that as luer tip 62 is withdrawn away from the vial, the frictional engagement between luer tip 62 and orifice 86 of the free plug will cause free plug 80 to withdraw distally within cavity 37 along with luer tip 62. It will be appreciated by the skilled artisan that the various components may be dimensioned or otherwise configured such that frictional forces between orifice 86 and luer tip 62 exceed frictional forces between cavity 37 and outside wall 88 of the free plug. Thus, free tip 62 remains fixed with free plug 80 until such time as free plug 80 has withdrawn to locking abutment 39. At this point, it will be seen that membrane 40 will have been resiliently deflected upwards towards its storage position, closing fluid path 54 by sealing engagement between membrane 40 and sealing rib 30. Further distal flow of fluid between open top 12 of the bottle through openings 44 is thus prevented. Luer tip 62 is withdrawn from orifice 86 only after membrane 40 has been restored to its storage position. Thus, splashback of fluid from the bottle is largely prevented if not otherwise eliminated because at no point will orifice 86 be exposed to a practitioner unless membrane 40 is restored to its sealed position. Furthermore, it will be appreciated by the skilled artisan that sealing action of secondary-seals 92 with opposed end 36 of the luer connector hub, together with the largely fluid-tight contact between cavity 37 of the luer connector hub and outside wall 88 of the free plug, all act to prevent the possibility of splashback flow of fluid through the luer connector hub.

FIG. 4 illustrates an alternate embodiment 200 of a resealable transfer assembly in accordance with the present invention. Here, body 220 is provided with an upstanding cylindrical extension 222 containing therein free plug 280. Cylindrical extension 222 includes an open distal end 224. Free plug 280 features open distal end 284 extending beyond distal end 224 of the cylindrical extension. Luer wings 235 can be provided on free plug 280 about its open distal end 284. Luer wings 235 are spaced from distal end 224 by a gap "B." In lieu of frictional engagement with the cylindrical extension, free plug 280 may feature threads 245 configured to mate with complimentary threads 246 formed on internal portions of cylindrical extension 222. One or more of sealing rings 250 may be disposed on portions of free plug 280 for sliding, fluid-tight contact with internal portions of cylindrical portion 222. Free plug 280 includes a proximal end 284 which can be configured for fluid-tight engagement with an open opposed end 236 of cylindrical section 222 when the free plug is urged towards an activated position. In one configuration, proximal end 284 of the free plug can include a tapered surface 285 which mates with a taper provided to opposed end 236 of the cylindrical extension when the free plug is positioned in an activated position.

After seal 100 has been removed from free plug 280, a luer connector tip (not shown) is inserted into orifice 286. Internal portions of luer lock collar 64 threadedly mate with luer wing 235 of the free plug, until such point as syringe 60 is locked onto free plug 280. Continued rotation of the syringe will cause free plug 280 to rotate within cylindrical extension 222, and by action of complimentary threaded structure 245, 246, the free plug is thus urged towards its activated position. Gap "B" is greater than the distance free plug 280 travels to reach its activated position, so that the luer wings do not prevent the free plug from reaching its activated position. Proximal end 284 of the free plug will exert force against central area 242 of membrane 240, as previously described. Accordingly, a fluid path will be open between the luer tip and the interior of the bottle. When it is desired to re-seal the bottle, a reverse-twisting action upon syringe 60 will cause free plug 280 and the luer tip of the medical delivery device to withdraw together upwards within upstanding cylindrical section 222 towards its storage position. As before described, frictional forces between the luer tip and luer wing 235 can be designed to slightly exceed frictional forces between free plug 280 and cylindrical extension 222. Membrane 240 will be sealed against ribs 230 before the luer-tip is withdrawn from cavity 286. Accordingly, in the manner previously described, splashback is largely prevented if not otherwise eliminated from the bottle, because cavity 286 is not exposed to a practitioner until membrane 240 has been sealed.

FIG. 5 illustrates a farther variant 300 of the resealable transfer assembly in accordance with the present invention. As seen with resealable transfer assembly 20, here, a cavity 337 provided in luer connector hub 332. Luer wings 335 are provided on luer connector hub 332. The open distal end 382 of free plug 380 is disposed within cavity 337. Free plug 380 and luer hub 332 are provided with a threaded connection 345, 346 as previously described in FIG. 4. Also, one or more sealing rings 350 can be disposed on exterior portions of free plug 380 for sealing, fluid-tight contact with cavity 337. As with the embodiment in FIG. 4, withdrawal of the luer tip from orifice 386 occurs at a point subsequent to re-sealing of membrane 340 with body 320. Hence, splashback of fluid is largely prevented if not otherwise eliminated.

If desired, it will be apparent to the skilled artisan that in lieu of a sealing rib 30 formed with the body or as an extension of the luer connector hub, a sealing rib 400 may be formed as part of the structure of membrane 40 itself (see FIG. 6). Sealing rib 400 may be located between the one or more openings 40 and central area 42. Thus, rib 400 will be urged into sealing contact with body 22 when membrane 40 returns to its closed position.

The various components associated with the luer connector hub or the body may be molded or otherwise formed from medical grade plastics, glass, or like materials. Similarly, bottle 10 may be either plastic or glass, as is conventional. Free plug 80, 280, 380 can be configured from various rigid plastic materials such as various thermoplastic materials, thermoset materials or the like. Similarly, as illustrated in FIG. 6*b*, the membrane can be configured from a non-elastomeric material such as plastics, metals, composites, or the like, so long as elasticity is imparted to permit central area 42 to move relative to edge 46 retained between the body and the top surface of the bottle. For instance, central area 42 could be suspended by one or more flexible cantilevers 500 affixed to edge 46, with spaces 502 provided to permit fluid flow.

Moreover, it will be realized that the membrane need not be secured between the body and the top surface of the bottle. For instance, the membrane could be associated with the body itself and engaged across the open top of the bottle, for instance, by being secured in the neck of the bottle. FIG. 8 illustrates an embodiment 600 of the resealable bottle assembly substantially as hereinbefore described albeit configured to retain the membrane against the neck of the bottle. A body 622 is provided, having a downwardly extending portion 622*b*. A luer connector hub 632 is provided with a free plug 680 therein. Downwardly extending portion 622*b* is configured for insertion into neck portion 613 of bottle 610. Membrane 640 includes an annular bead 648 retained between neck portion 613 and a complementary groove 660 formed on downwardly extending portion 622*b*. One or more annular ribs 649 may also be provided on membrane 240 distal of annular bead 648. While body 622 may be secured to annular rim 615 via a crimp cap, as here shown, body 622 is threadedly secured to annular rim 615 via complementary threads 628, 626 formed on the annular rim and sidewall 627 of the body, respectively. As in the previously described embodiments, membrane 640 rests between the proximal end of the free plug 680 (via downwardly extending portion 622*b*) and the open top of the bottle for opening and closing of the fluid path. It will be realized that by this configuration annular bead 648 and, if provided, the one or more annular ribs 649, may also act as a stopper for bottle 610.

It will be appreciated and understood by those skilled in the art that further and additional forms of the invention may be devised without departing from the spirit and scope of the appended claims, the invention not being limited to the specific embodiments shown.

We claim:

1. A resealable transfer assembly accessible by a medical delivery device and providing a resealable fluid path between the medical delivery device and the container, comprising:

a container having an open top and a top surface disposed around portions of the container surrounding said open top;

a body disposed adjacent the top surface of the container, the body including a concave taper adjacent the open top of the container;

means for communicating fluids with the container, said means having a distal end configured for initiating fluid communication with the medical delivery device, an opposed end disposed on said body for fluid communication with the open top of the container and a cavity defined therebetween;

a free plug disposed within the cavity defined by the means for communicating fluids, the free plug dimensioned for axial movement within the cavity, the free plug defining an orifice for accepting a medical delivery device, the free plug including a proximal end disposed for sealing relation with the opposed end of the means for communicating;

a membrane disposed between the open top of said container and the opposed end of the means for communicating, said membrane having a central area disposed for contact with the proximal end of the free plug, the central area having a width at least equal to the width defined by the opposed end of the means for communicating, said membrane having at least one fluid passage located outside said central area for fluid communication between the opposed end of the means for communicating and the open top of the container, and said membrane defining a sealing portion between said central area and said at least one fluid passage for sealing contact with the body; and a plurality of sealing ribs disposed about at least a portion of the periphery of said opposed end of the means for communicating for sealing contact with said membrane in the closed position, wherein upon insertion of the component of the medical delivery device into the orifice of the free plug said membrane is displaced to an activated position, wherein said membrane is urged away from sealing contact with the body to open the fluid path between the medical deliver device and the open top of the container, and wherein upon a removal of the component from the orifice, the membrane will be returned to sealing contact with the body before the component is decoupled from the orifice to avert splashback of fluid from the container.

2. The resealable transfer assembly of claim 1, wherein said means for communicating comprises a luer connector hub.

3. The resealable transfer assembly of claim 1, wherein said central area comprises at least one fluid flow channel to facilitate fluid flow between said medical delivery device and said bottle.

4. The resealable transfer assembly of claim 3, wherein said at least one fluid flow channel comprises spaces defined between at least two raised protrusions provided on said central area.

5. The resealable transfer assembly of claim 3, wherein said at least one fluid flow channel comprises at least one trough formed on the surface of the central area.

6. The resealable transfer assembly of claim 1, further comprising a sealing rib disposed about at least a portion of the periphery of said opposed end of the means for communicating, said sealing rib disposed for said sealing contact with said membrane when said membrane is in the closed position.

7. The resealable transfer assembly of claim 6, wherein when said free plug displaces said membrane to the activated position, said membrane is urged from sealing contact with said sealing rib to create a gap between the membrane and the sealing rib, thereby opening the fluid path between the medical delivery device and the open top of the container.

8. The resealable transfer assembly of claim 1, wherein said membrane comprises an elastomeric element.

9. The resealable transfer assembly of claim 1, wherein the proximal end of the free plug comprises a proximally directed neck and the opposed end of the means for communicating comprises a cylindrical section, the proximally directed neck of the free plug disposed in sealing surface contact with the cylindrical section of the opposed end.

10. The resealable transfer assembly of claim 9, wherein at least one sealing ring is disposed between the proximally directed neck of the free plug and the cylindrical section of the opposed end.

11. The resealable transfer assembly of claim 1, wherein the proximal end of the free plug comprises a first tapered section and the opposed end of the means for communicating comprises a second tapered section configured for complementary sealing contact with the first tapered section of the free plug.

12. The resealable transfer assembly of claim 1, wherein the orifice of the free plug is shaped with a taper conforming to the shape associated with a luer tip of a medical delivery device.

13. The resealable transfer assembly of claim 1, further comprising a sealing rib disposed on said membrane for contact with said body outside of the periphery of the opposed end of the means for communicating.

14. The resealable transfer assembly of claim 2, wherein the free plug is mated to the cavity of the means for communicating by a threaded connection.

15. The resealable transfer assembly of claim 2, wherein a luer wing is disposed about the distal end of the luer connector hub.

16. The resealable transfer assembly of claim 14, wherein a luer wing is disposed about the distal end of the free plug.

17. The resealable transfer assembly of claim 14, wherein a luer wing is disposed about the distal end of the luer connection hub.

18. The resealable transfer container assembly of claim 1, wherein said top surface of the container comprises an uppermost surface of an annular rim disposed about the open top of the container.

19. The resealable transfer assembly of claim 18, further comprising a crimp cap for securing said body to said annular rim.

20. The resealable transfer assembly of claim 2, further comprising an external seal for sealing the connector end of the luer connector hub.

21. The resealable transfer assembly of claim 20 wherein said external seal comprises a removable membrane.

22. The resealable transfer assembly of claim 1, wherein the fluid passages comprise openings.

23. The resealable transfer assembly of claim 2, wherein the fluid passages comprise slits.

24. The resealable transfer assembly of claim 1, wherein said membrane comprises a non-elastomeric material.

25. A resealable transfer assembly accessible by a medical delivery device and providing a resealable fluid path between the medical delivery device and the container, comprising:

a container having an open top and a top surface disposed around portions of the container surrounding said open top;

a body disposed adjacent the top surface of the container, the body including a concave taper adjacent the open top of the container;

means for communicating fluids with the container, said means including a luer connector hub having a distal end configured for initiating fluid communication with the medical delivery device, an opposed end disposed on said body for fluid communication with the open top of the container and a cavity defined therebetween:

a free plug disposed within the cavity defined by the means for communicating fluids, the free plug dimensioned for axial movement within the cavity, the free plug defining an orifice for accepting a medical delivery device, the free plug including a proximal end disposed for sealing relation with the opposed end of the means for communicating;

a membrane disposed between the open top of said container and the opposed end of the mans for communicating, said membrane having a central area disposed for contact with the proximal end of the free plug the central area having a width at least equal to the width defined by the opposed end of the means for communicating, said membrane having at least one fluid passage located outside said central area for fluid communication between the opposed end of the means for communicating and the open top of the container, and said membrane defining a sealing portion between said central area and said at least one fluid passage for sealing contact with the body; and an external seal for sealing the connector end of the luer connector hub, said external seal comprises a luer connector seal having a top wall and an annular side wall projecting from said top wall, said annular side wall including an array of internal threads selectively engageable with the connector end of said luer connector hub, and a seal disposed between said top wall and the connector end of the luer connector hub for sealingly engaging said connector end;

wherein upon insertion of the component of the medical delivery device into the orifice of the free plug, said membrane is displaced to an activated position, wherein said membrane is urged away from sealing contact with the body to open the fluid path between the medical delivery device and the open top of the container, and wherein upon a removal of the component from the orifice, the membrane will be returned to sealing contact with the body before the component is decoupled from the orifice to avert splashback of fluid from the container.

* * * * *